US005724836A

United States Patent [19]

Green

[11] Patent Number: 5,724,836

[45] Date of Patent: Mar. 10, 1998

[54] SOCK WITH BREATHABLE PANEL

[75] Inventor: David Green, High Point, N.C.

[73] Assignee: Sara Lee Corporation, Winston-Salem, N.C.

[21] Appl. No.: 680,990

[22] Filed: Jul. 16, 1996

[51] Int. Cl.[6] ..... A41B 11/00

[52] U.S. Cl. ..... 66/185; 2/239

[58] Field of Search ..... 66/169 R, 171, 66/172 R, 178 R, 180, 183, 184, 185, 186, 187, 188, 182, 181, 189; 2/239, 241, 242

[56] References Cited

U.S. PATENT DOCUMENTS

| | | | |
|---|---|---|---|
| D. 125,324 | 2/1941 | Camp | D47/7 |
| D. 175,794 | 11/1955 | Oliver | D47/7 |
| 1,136,097 | 4/1915 | Cahn | 66/185 |
| 2,130,018 | 9/1938 | Lochhead | 66/185 |
| 2,239,593 | 4/1941 | Crawford | 66/185 |
| 3,146,468 | 9/1964 | McDonald | 2/239 |
| 4,057,981 | 11/1977 | Runac | 66/185 |
| 4,255,949 | 3/1981 | Thorneburg | 66/185 |
| 4,277,959 | 7/1981 | Thorneburg | 66/182 |
| 4,520,635 | 6/1985 | Shields et al. | 66/185 |
| 4,898,007 | 2/1990 | Dahlgren | 66/185 |
| 5,307,522 | 5/1994 | Thorneburg et al. | 66/185 |
| 5,319,807 | 6/1994 | Brier | 2/239 |

OTHER PUBLICATIONS

PrimaSport® sock by Kayser–Roth, believed to be prior art.

*Primary Examiner*—C. D. Crowder
*Assistant Examiner*—Larry D. Worrell, Jr.
*Attorney, Agent, or Firm*—Rhodes, Coats & Bennett, L.L.P.

[57] ABSTRACT

A knit athletic sock having a leg section and a foot section which includes a sole section intermediate a toe section and a heel section having internal-facing terry loops to form a cushion. A breathable instep panel is positioned atop the sole section, wherein the instep panel extends from the wearer's ankle to the toe section. A transition zone is located between the foot section and the leg section to provide additional comfort and durability.

35 Claims, 3 Drawing Sheets

SOCK WITH BREATHABLE PANEL

BACKGROUND OF THE INVENTION (1) Field of the Invention

The present invention relates generally to hosiery and, more particularly, to a sock having a cushion foot and a breathable panel.

(2) Description of the Prior Art

Manufacturers have provided socks with internal facing terry loops to provide a "cushion" foot construction. The terry loops aid in cushioning the impact on the foot during activity such as running or jumping and even walking. A sock wearer's foot can perspire heavily during these activities causing the foot to become uncomfortable. After cooling off from exercise, any excess moisture retained in the sock yarn creates a very cold, clammy feeling for the wearer.

To combat these problems a variety of sock constructions have been developed which incorporate some combination of hydrophobic (non-absorbent) yarns and hydrophilic (absorbent) yarns. These yarns are arranged to carry away or wick moisture from the wearer's foot so that the moisture can evaporate naturally. Examples of wicking yarns include acrylics and polypropylene. Examples of non-wicking yarns include cotton and wool.

Another technique for addressing foot moisture control is the placement of zones of open stitching in certain areas of a sock. An example is the sock disclosed in U.S. Pat. No. 4,057,981 to Runac which discloses ventilator panels formed of an open mesh stitch construction. The ventilator panels are located along opposite sides of the sole of the sock. Other techniques involve the attempts to optimize the placement and use of hydrophilic yarns. Examples include socks described in U.S. Pat. Nos. 5,319,807 and 4,898,007.

Also a sock sold by Kayser-Roth Corporation under the trademark PRIMASPORT® attempts to address these problems by incorporating an unattractive and bulky external-facing terry loops along the sole of the sock with some form of open stitching.

These prior attempts have not successfully combined wicking and cushioning attributes to produce a truly comfortable and aesthetically pleasing sock. Thus, there remains a need for a new and improved sock which provides the benefits of cushioning while, at the same time, is adapted to maintain the wearer's foot cool and dry.

SUMMARY OF THE INVENTION

The present invention is directed to a knit athletic sock having a leg section and a foot section. The foot section includes a sole section intermediate a toe section and a heel section having internal-facing terry loops to form a cushion. A breathable instep panel is positioned atop the sole section, wherein the instep panel extends from the wearer's ankle to the toe section. Finally, a transition zone is located between the foot section and the leg section to provide additional comfort and durability.

In a preferred embodiment, the sole section is formed from a body yarn knitted in plated relationship with a hydrophobic yarn and a hydrophilic yarn. The hydrophilic yarn preferably is cotton and the hydrophobic yarn is high bulk acrylic. In the most preferred embodiment, the sole section is formed from about 50% hydrophobic yarn and about 50% hydrophilic yarn.

In another preferred embodiment, the breathable panel is formed using an open stitch, preferably a tuck stitch. In addition, preferably the panel is formed from a blend of cotton and polyester yarns.

In another embodiment, a sock has a foot section, the foot section including: (a) a sole section intermediate a toe section and a heel section, the sole section including internal-facing terry loops to form a cushion; and (b) a breathable instep panel positioned atop the sole section.

Another aspect of the present invention is to provide a cooling panel for a knit athletic sock having a foot section, the foot section including a sole section intermediate a toe section and a heel section, the panel including a breathable instep panel positioned atop the sole portion, wherein the instep panel extends from the wearer's ankle to the toe section.

Still another aspect of the present invention is to provide a knit athletic sock having a leg section and a foot section, the foot section including: (a) a sole section intermediate a toe section and a heel section, the sole section including internal-facing terry loops to form a cushion; (b) a breathable instep panel positioned atop the sole section, wherein the instep panel extends from the wearer's ankle to the toe section; and (c) a transition zone between the foot section and the leg section.

These and other aspects of the present invention will become apparent to those skilled in the art after a reading of the following description of the preferred embodiment when considered with the drawings.

DESCRIPTION OF THE PREFERRED EMBODIMENTS

Figure 1:
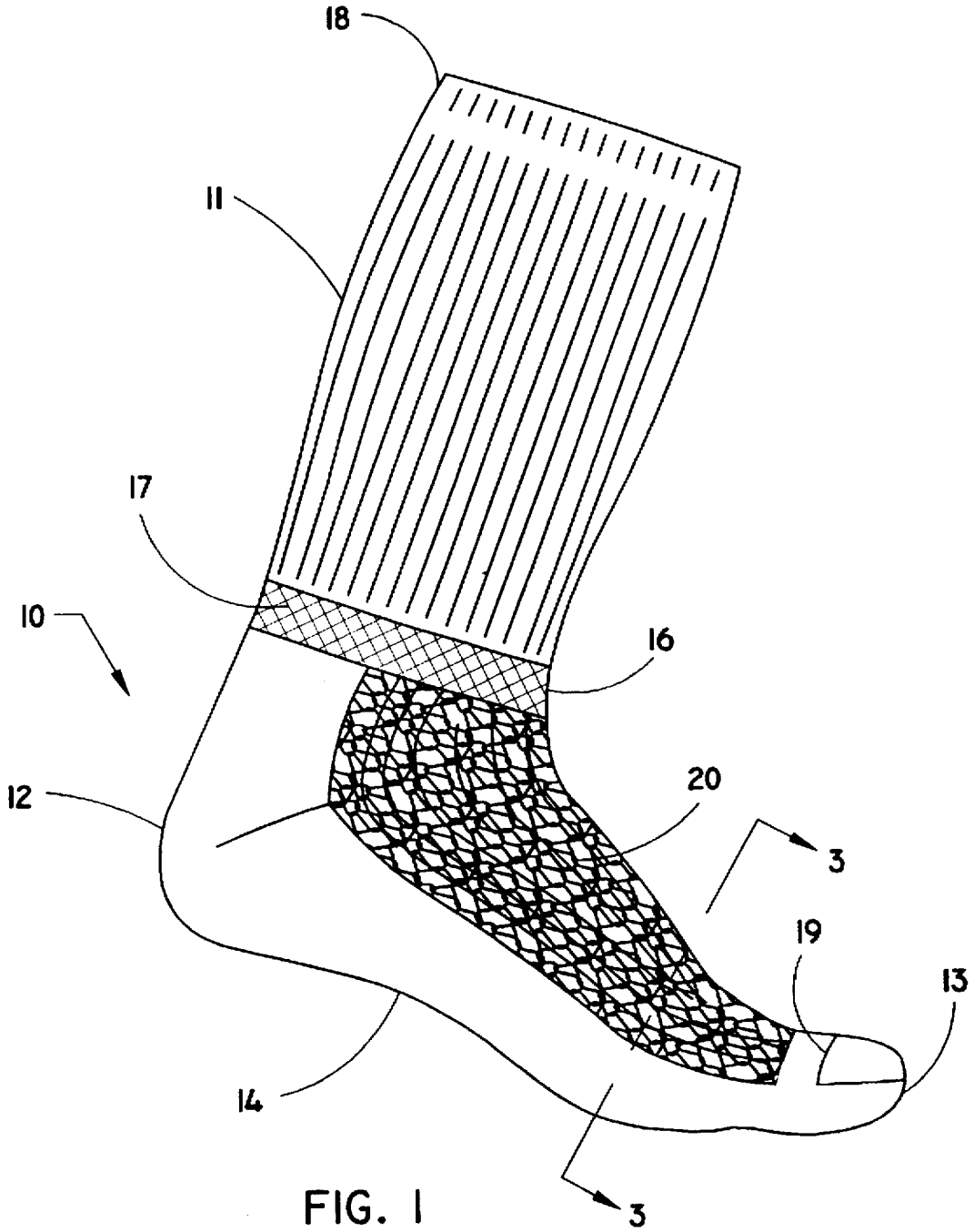
FIG. 1 is a side elevation showing a sock according to the present invention.

In the following description, like reference characters designate like or corresponding parts throughout the several views.

Referring now to the drawings in general and FIG. 1 in particular, it will be understood that the illustrations are for the purpose of describing a preferred embodiment of the invention and are not intended to limit the invention thereto. As best seen in FIG. 1, an athletic sock, generally designated 10, is shown constructed according to the present invention.

The sock includes a leg 11 which can be manufactured using any well-known rib-knit or other structure common in the art. The foot of the sock includes a heel section 12, a toe section 13, and sole portion 14 intermediate the heel section 12 and the toe section 13. Positioned atop the sole section 14 is an integrally knitted breathable panel 20. The breathable panel covers most of the top of the wearer's foot and extends from the ankle 16 to the toe section 13. A transition zone 17 is positioned between the leg 11 and the foot.

Socks of the type contemplated by the present invention are typically manufactured using well-known circular knitting machines. In a preferred embodiment as illustrated in FIG. 1 the heel section 12 is constructed using a knit in heel. The toe section can be constructed using one of two well-known methods. The toe section can be sewn closed, in which case the sock structure is removed from the knitting machine having an open toe. The toe is then sewn closed on a sewing machine specifically designed for this purpose. When the sock is constructed with the sewn toe, it will include seam 19 as illustrated in FIG. 1. Alternatively, the toe section 13 can actually be knitted closed by the knitting machine. The scope of the present invention includes employing either of these methods.

The present invention is shown in FIG. 1 having a leg section extending upwardly above the foot and topped with elastic band 18. It should be understood that the present invention can be practiced in a sock having a very short leg or no leg at all. In those cases where no leg is provided, an elastic band or cuff of some type would be provided at the point where the transition zone 17 is shown in FIG. 1.

Figure 2:
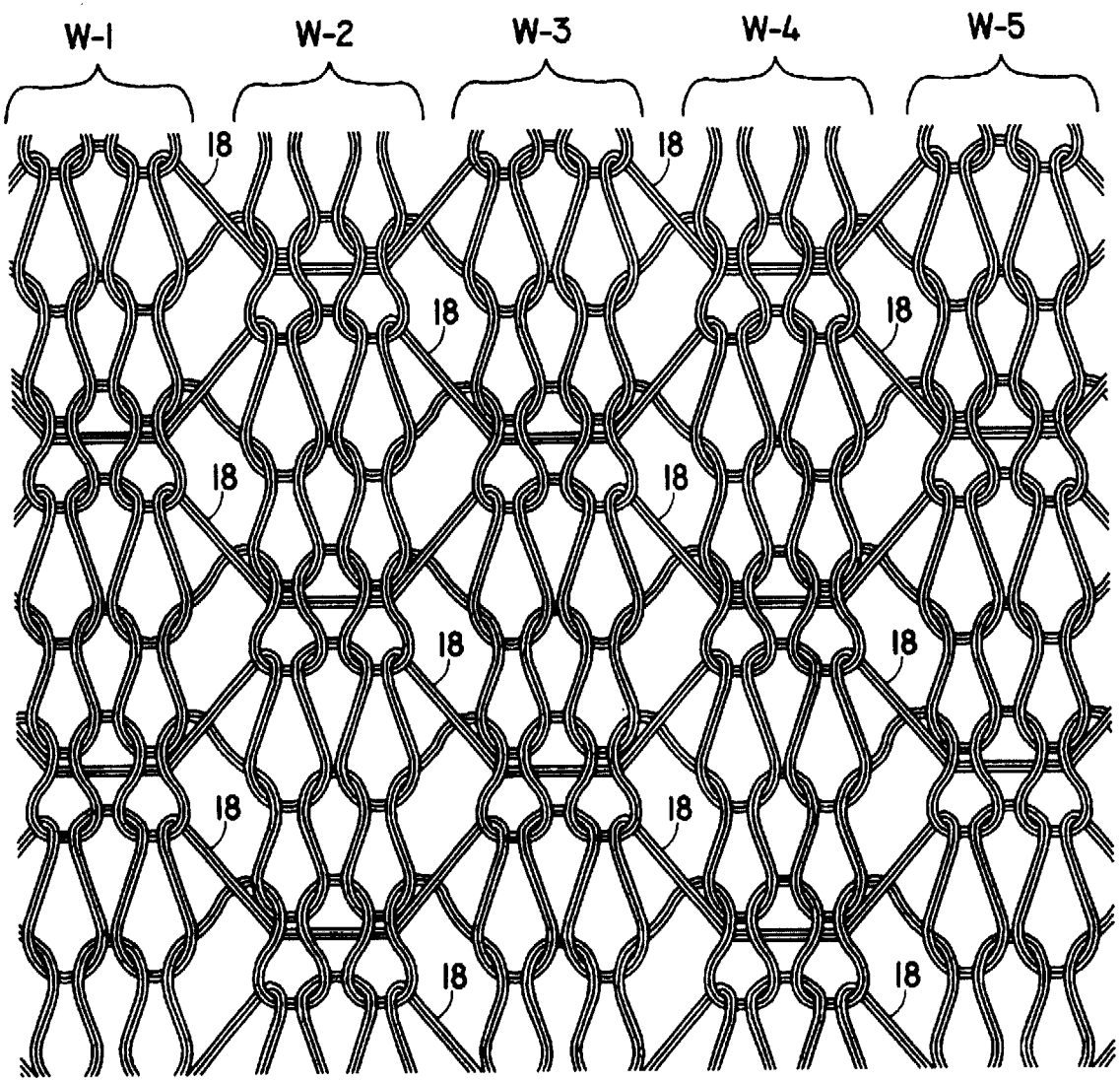
FIG. 2 is an enlarged detail of the open knit used in the sock of the present invention.

The breathable panel 20 is knit using an open stitch to help maintain the wearer's foot cool and dry. A preferred open stitch is the tuck stitch as illustrated in enlarged detail in FIG. 2. The stitching in the breathable panel is accomplished using cotton and polyester yarns in an alternate knitting and tucking pattern. In the first course of this pattern, tuck loops 18 are formed by side-by-side pairs of needles loading yarn without shedding a previously formed loop. The wales W-1 through W-5 formed by the pairs of needles are two loops wide. Similarly situated pairs of needles on either side of the tuck forming needles shed a previous loop as is done in conventional jersey knitting. The next knitting course sheds all previous loops. The third course is formed in similar fashion to the first course except that the pair of needles used to form the tuck loop is alternated. The fourth knit course is formed in an identical fashion to the second knit course. This four course pattern is repeated to form the pattern shown in FIG. 2. An advantage of using side-by-side pairs of needles to form the tuck stitch is that a functional, open-stitch area is created without forming a mesh structure or appearance. It is believed that a mesh structure would not be suitable for the breathable panel of the present invention. Increasing the number of tuck loops would create a more open stitch; however, it would also increase the amount of tension in the material leading to yarn rupture or needle damage. Accordingly, the tuck stitch of the present invention can be knit on a high volume basis with increased efficiency and decreased downtime due to the yarn rupture.

The present invention includes providing the breathable panel described above on the instep portion of the stock. This instep portion can be described as extending from the toe area from about the point of toe cleavage upwards to the top of the ankle. The width of the panel extends from one side of the sock at the top of the sole section upwards and over across the top of the foot to the opposite side of the sock to the sole section. Although a preferred size is shown in FIG. 1, it is within the knowledge of one of ordinary skill in the art to modify the size of the panel to alter the degree of cooling desired. The breathable panel 20 of the sock of the present invention does not include terry loops. The panel lies in direct contact with the skin of the wearer's foot.

Figure 3:
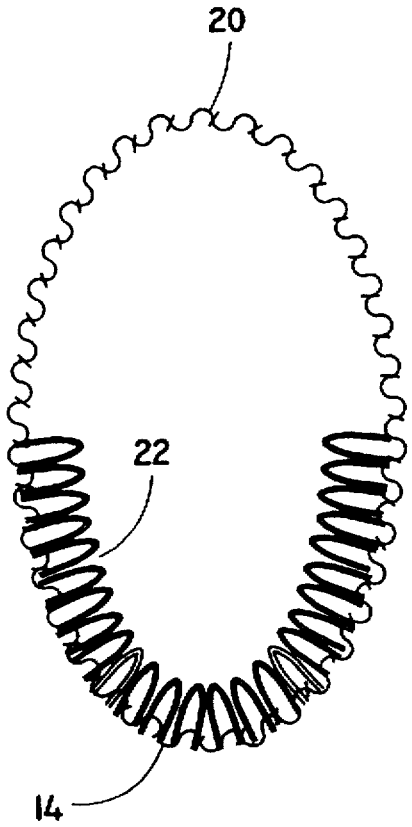
FIG. 3 is a cross-sectional view taken through the foot of the sock of the present invention along line 3—3 in FIG. 1.

The heel 12, toe 13, and sole 14 sections of the sock are formed with internal-facing terry loops 22. The density of the terry loops is constant throughout each of those sections. The relationship between the terry loop sections of the sock and the breathable panel is illustrated in FIG. 3, which is a cross sectional view of the sock taken along 3—3 in FIG. 1. The terry loops 22 form a cushioned area for the wearer's foot. This cushioned area is much thicker than the breathable panel 20. FIG. 3 shows that the breathable panel 20 comprises about half the circumference of the sock along section line 3—3. However, when the sock is placed on a wearer's foot the panel 20 stretches more across its width than does the sole section 14. Therefore the breathable panel may occupy a greater proportion of the foot circumference than the sole section.

The selection of yarns used in each section of the sock of the present invention varies with the function performed by the section. In a preferred embodiment of FIG. 1, the breathable panel 20 is composed of a hydrophilic yarn and another yarn selected for its durability. The hydrophilic yarn can be cotton and the durable yarn can be polyester. The breathable panel does not require the presence of a wicking yarn because its evaporative and cooling functions rely on the use of an open stitch. The cotton yarn contained in the sock is a single count yarn having a denier of between about 300 and 440.

The internal-facing terry loops are knit using cotton and acrylic yarns. Acrylic and polyester yarn are plaited to the outside of the cushion sections of the sock. The term "plaited" as used herein is also referred to as "plated" in the art. Preferably a high bulk acrylic yarn is used to take advantage not only of its wicking ability but also to take advantage of its softness. The acrylic yarn has a denier of between about 250 and 450. The polyester yarn has a denier of between about 100 and 200.

This combination of hydrophilic and hydrophobic yarns in the heel, toe and sole sections of the sock serves to wick moisture away from the wearer's foot as it perspires. The amount of each type of yarn used in the moisture-wicking areas of the sock can be varied as desired. Preferably those areas are composed of about fifty percent hydrophobic yarn and about fifty percent hydrophilic yarn. It should be noted that the polyester yarn is provided to improve the sock's wear characteristics and is not depended upon for the wicking function. The sock will function as described herein without the polyester yarn.

Although the present invention has been described with preferred embodiments, it is to be understood that modifications and variations may be utilized without departing from the spirit and scope of this invention, as those skilled in the art will readily understand. Such modifications and variations have been deleted herein for the sake of conciseness and readability but are considered to be within the purview and scope of the appended claims and their equivalents.

I claim:

1. A sock having a foot section, the foot section comprising:

(a) a sole section intermediate a toe section and a heel section, the sole section including internal-facing terry loops to form a cushion; and (b) a breathable instep panel positioned atop the sole section substantially over the top of the wearer's foot, and wherein the instep panel comprises a stitch that is more open than the stitch of the sole section.

2. The sock of claim 1 further comprising a leg section and a transition zone between the foot section and the leg section.

3. The sock of claim 1 wherein the sole section is comprised of a body yarn knitted in plated relationship with a hydrophobic yarn and a hydrophilic yarn.

4. The sock of claim 3 wherein the hydrophilic yarn is cotton.

5. The sock of claim 4 wherein the hydrophilic yarn has a denier of between about 300 and 440.

6. The sock of claim 3 wherein the hydrophobic yarn is acrylic.

7. The sock of claim 6 wherein the hydrophobic yarn is a high bulk acrylic.

8. The sock of claim 6 wherein the acrylic yarn has a denier of between about 250 and 450.

9. The sock of claim 3 wherein the sole section is formed from about 50% hydrophobic yarn and about 50% hydrophilic yarn.

10. The sock of claim 1 wherein the toe section is sewn closed.

11. The sock of claim 1 wherein the toe section is knitted closed.

12. The sock of claim 1 wherein the heel section is a knit in heel.

13. A cooling panel for a knit athletic sock having a foot section, the foot section including a sole section intermediate a toe section and a heel section, the panel comprising: a breathable instep panel positioned atop the sole section, wherein the instep panel extends from the wearer's ankle to the toe section and substantially over the top of the wearer's foot, and comprises a stitch that is more open than the stitch of the sole section.

14. The sock of claim 13 wherein the breathable panel is formed using an open stitch.

15. The sock of claim 14 wherein the open stitch is a tuck stitch.

16. The sock of claim 13 wherein the breathable panel is formed from cotton and polyester yarns.

17. The sock of claim 16 wherein the cotton yarn has a denier of between about 300 and 440.

18. The sock of claim 16 wherein the polyester yarn has a denier of between about 100 and 200.

19. A knit athletic sock having a leg section and a foot section, the foot section comprising:

(a) a sole section intermediate a toe section and a heel section, the sole section including internal-facing terry loops to form a cushion;

(b) a breathable instep panel comprising a stitch that is more open than the stitch of the sole section, the panel positioned atop the sole section substantially over the top of the wearer's foot, wherein the instep panel extends from the wearer's ankle to the toe section; and (c) a transition zone between the foot section and the leg section.

20. The sock of claim 19 wherein the sole section is comprised of a body yarn knitted in plated relationship with a hydrophobic yarn and a hydrophilic yarn.

21. The sock of claim 20 wherein the hydrophilic yarn is cotton.

22. The sock of claim 21 wherein the hydrophilic yarn has a denier of between about 300 and 440.

23. The sock of claim 20 wherein the hydrophobic yarn is acrylic.

24. The sock of claim 23 wherein the hydrophobic yarn is a high bulk acrylic.

25. The sock of claim 23 wherein the acrylic yarn has a denier of between about 250 and 450.

26. The sock of claim 20 wherein the sole section is formed from 50% hydrophobic yarn and 50% hydrophilic yarn.

27. The sock of claim 19 wherein the toe section is sewn closed.

28. The sock of claim 19 wherein the toe section is knitted closed.

29. The sock of claim 19 wherein the heel section is a knit in heel.

30. The sock of claim 19 wherein the breathable panel is formed using an open stitch.

31. The sock of claim 30 wherein the open stitch is a tuck stitch.

32. The sock of claim 19 wherein the breathable panel is formed from cotton and polyester yarns.

33. The sock of claim 32 wherein the cotton yarn has a denier of between about 300 and 440.

34. The sock of claim 32 wherein the polyester yarn has a denier of between about 100 and 200.

35. A method of forming a breathable panel for use in a sock comprising:

(a) knitting a single course of stitches using a tuck stitch having a tuck stitch loop wherein the tuck stitch loop is created by side-by-side pairs of needles;

(b) knitting a second single course of stitches using a plain stitch shedding all previous stitch loops;

(c) knitting a third course of stitches according to step (a) on alternate pairs of needles;

(d) knitting a fourth course of stitches according to step (b) shedding all previous stitch loops; and (e) repeating steps (a) through (d) until a panel of desired size is formed.

* * * * *